US006378866B1

(12) United States Patent
Graham-Ward

(10) Patent No.: US 6,378,866 B1
(45) Date of Patent: Apr. 30, 2002

(54) SUMMATION OF NUMBERS BOARD PUZZLE

(76) Inventor: Christopher D. Graham-Ward, P.O. Box HM 428, Hamilton HMBX (BM)

( * ) Notice: Subject to any disclaimer, the term of this patent is extended or adjusted under 35 U.S.C. 154(b) by 0 days.

(21) Appl. No.: 09/512,684

(22) Filed: Feb. 25, 2000

(51) Int. Cl.[7] ..... A63F 9/06
(52) U.S. Cl. ..... 273/153 R
(58) Field of Search ..... 273/153 R, 157 R, 273/153 S, 267

(56) References Cited

U.S. PATENT DOCUMENTS

| | | | | | |
|---|---|---|---|---|---|
| 388,226 | A | * | 8/1888 | Simpson | 273/153 R |
| 930,151 | A | * | 8/1909 | Brown | 273/153 R |
| 1,457,383 | A | * | 6/1923 | Miller | 273/153 R |
| 1,494,876 | A | | 5/1924 | Zander | |
| 1,550,230 | A | * | 8/1925 | Taylor | 273/153 R |
| 1,554,910 | A | * | 9/1925 | Fitzsimons | 273/153 R |
| 1,561,098 | A | * | 11/1925 | Meehan | 273/153 R |
| 1,698,780 | A | * | 1/1929 | Darrow | 273/153 R |
| 3,229,388 | A | | 1/1966 | Smith | |
| 3,851,409 | A | | 12/1974 | Teahan | |
| 3,966,209 | A | * | 6/1976 | Gambardella | 273/153 R |
| 4,421,314 | A | | 12/1983 | Stancill | |
| 5,261,671 | A | | 11/1993 | Wyatt | |
| D363,954 | S | | 11/1995 | Serrano | |
| 5,649,703 | A | * | 7/1997 | Kanbar | 273/157 R |

* cited by examiner

*Primary Examiner*—Steven Wong

(57) ABSTRACT

A summation of numbers board puzzle for an entertaining and enjoyable challenge. The summation of numbers board puzzle includes multiple game boards each of which has a plurality of holes respectively arranged in a triangular pattern therein with each vertex of the triangular pattern having its own hole, and includes two sets of twelve pegs each with each peg in each set having an exclusive number imprinted thereon, and also includes three tip cards for providing assistance in solving the summation puzzle, and further includes an answer sheet disposed in a sealable member for use only when absolutely needed, and in addition includes a container having a removable cover and having partitioned compartments therein for storing the game boards, the two sets of pegs, the tip cards, and the answer sheet. The user arranges the pegs in the holes in the game board member such that the sum of numbers along a side of the triangular pattern equals the sum of numbers along each of the remaining sides.

12 Claims, 2 Drawing Sheets

SUMMATION OF NUMBERS BOARD PUZZLE

BACKGROUND OF THE INVENTION

1. Field of the Invention

The present invention relates to three-sided summation of numbers puzzle and more particularly pertains to a new summation of numbers board puzzle for an entertaining and enjoyable challenge.

2. Description of the Prior Art

The use of three-sided summation of numbers puzzle is known in the prior art. More specifically, three-sided summation of numbers puzzle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,229,388; U.S. Pat. No. 3,851.409; U.S. Pat. No. Des. 363,954; U.S. Pat. No. 4,421,314; U.S. Pat. No. 5,261,671; and U.S. Pat. No. 1,494,876.

While these devices fulfill their respective, particular objectives and requirements, the aforementioned patents do not disclose a new summation of numbers board puzzle. The inventive device includes multiple game boards each of which has a plurality of holes respectively arranged in a triangular pattern therein with each vertex of the triangular pattern having its own hole, and includes two sets of twelve pegs each with each peg in each set having an exclusive number imprinted thereon, and also includes three tip cards for providing assistance in solving the summation puzzle, and further includes an answer sheet disposed in a sealable member for use only when absolutely needed, and in addition includes a container having a removable cover and having partitioned compartments therein for storing the game boards, the two sets of pegs, the tip cards, and the answer sheet. The user arranges the pegs in the holes in the game board member such that the sum of numbers along a side of the triangular pattern equals the sum of numbers along each of the remaining sides.

In these respects, the summation of numbers board puzzle according to the present invention substantially departs from the conventional concepts and designs of the prior art, and in so doing provides an apparatus primarily developed for the purpose of an entertaining and enjoyable challenge.

SUMMARY OF THE INVENTION

In view of the foregoing disadvantages inherent in the known types of three-sided summation of numbers puzzle now present in the prior art, the present invention provides a new summation of numbers board puzzle construction wherein the same can be utilized for an entertaining and enjoyable challenge.

The general purpose of the present invention, which will be described subsequently in greater detail, is to provide a new summation of numbers board puzzle and method which has many of the advantages of the three-sided summation of numbers puzzle mentioned heretofore and many novel features that result in a new summation of numbers board puzzle which is not anticipated, rendered obvious, suggested, or even implied by any of the prior art three-sided summation of numbers puzzle, either alone or in any combination thereof.

To attain this, the present invention generally comprises multiple game boards each of which has a plurality of holes respectively arranged in a triangular pattern therein with each vertex of the triangular pattern having its own hole, and includes two sets of twelve pegs each with each peg in each set having an exclusive number imprinted thereon, and also includes three tip cards for providing assistance in solving the summation puzzle, and further includes an answer sheet disposed in a sealable member for use only when absolutely needed, and in addition includes a container having a removable cover and having partitioned compartments therein for storing the game boards, the two sets of pegs, the tip cards, and the answer sheet. The user arranges the pegs in the holes in the game board member such that the sum of numbers along a side of the triangular pattern equals the sum of numbers along each of the remaining sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new summation of numbers board puzzle and method which has many of the advantages of the three-sided summation of numbers puzzle mentioned heretofore and many novel features that result in a new summation of numbers board puzzle which is not anticipated, rendered obvious, suggested, or even implied by any of the prior art three-sided summation of numbers puzzle, either alone or in any combination thereof.

It is another object of the present invention to provide a new summation of numbers board puzzle which may be easily and efficiently manufactured and marketed.

It is a further object of the present invention to provide a new summation of numbers board puzzle which is of a durable and reliable construction.

An even further object of the present invention is to provide a new summation of numbers board puzzle which is susceptible of a low cost of manufacture with regard to both materials and labor, and which accordingly is then susceptible of low prices of sale to the consuming public, thereby making such summation of numbers board puzzle economically available to the buying public.

Still yet another object of the present invention is to provide a new summation of numbers board puzzle which provides in the apparatuses and methods of the prior art some of the advantages thereof, while simultaneously overcoming some of the disadvantages normally associated therewith.

Still another object of the present invention is to provide a new summation of numbers board puzzle for an entertaining and enjoyable challenge.

Yet another object of the present invention is to provide a new summation of numbers board puzzle which includes multiple game boards each of which has a plurality of holes respectively arranged in a triangular pattern therein with each vertex of the triangular pattern having its own hole, and includes two sets of twelve pegs each with each peg in each set having an exclusive number imprinted thereon, and also includes three tip cards for providing assistance in solving the summation puzzle, and further includes an answer sheet disposed in a sealable member for use only when absolutely needed, and in addition includes a container having a removable cover and having partitioned compartments therein for storing the game boards, the two sets of pegs, the tip cards, and the answer sheet. The user arranges the pegs in the holes in the game board member such that the sum of numbers along a side of the triangular pattern equals the sum of numbers along each of the remaining sides.

Still yet another object of the present invention is to provide a new summation of numbers board puzzle that tests the ability of the user to manipulate numbers towards a particular solution.

Even still another object of the present invention is to provide a new summation of numbers board puzzle that is method by which the user can relieve stress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
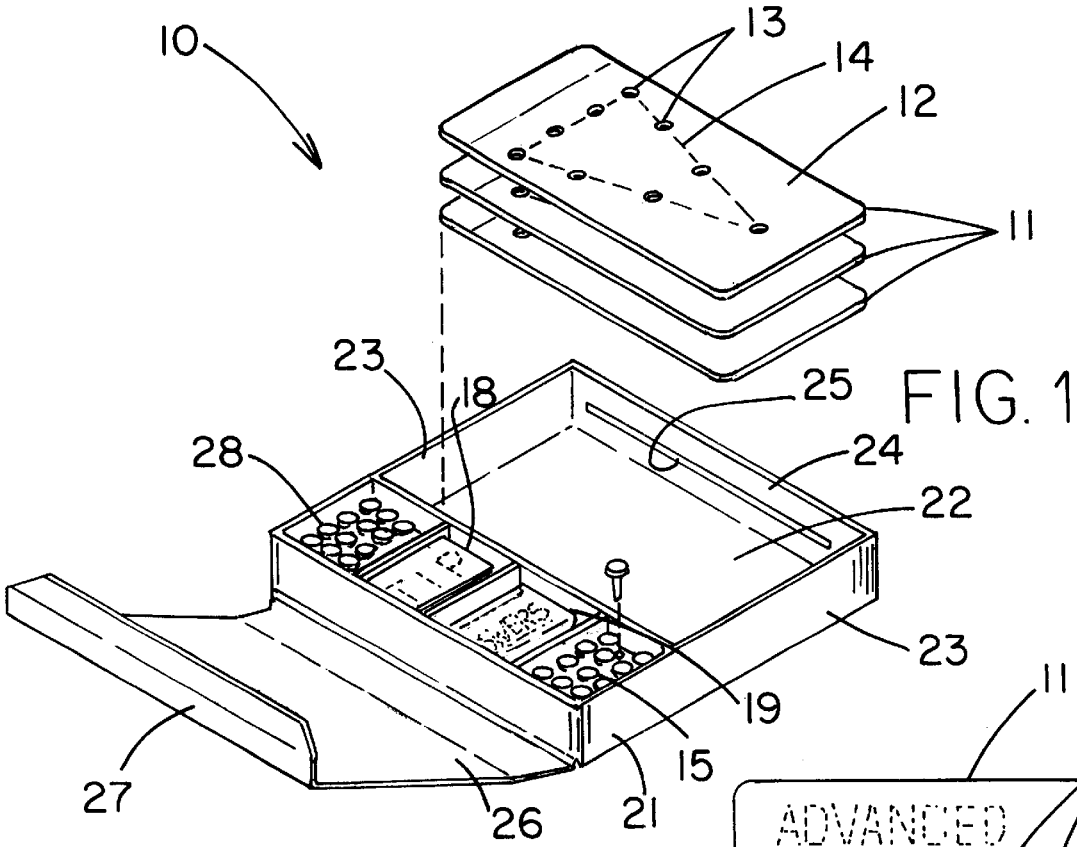
FIG. 1 is a perspective view of a new summation of numbers board puzzle according to the present invention.
Figure 3:
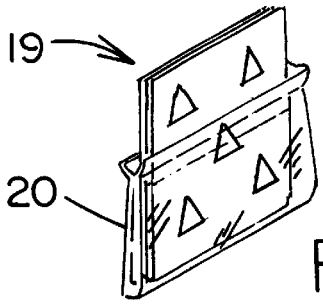
FIG. 3 is a perspective view of the sealed answer sheet of the present invention.
Figure 4:
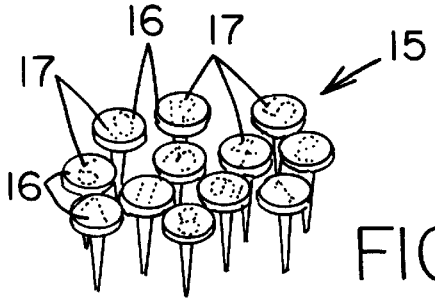
FIG. 4 is a top perspective view one of the sets of numbered pegs of the present invention.
Figure 2:
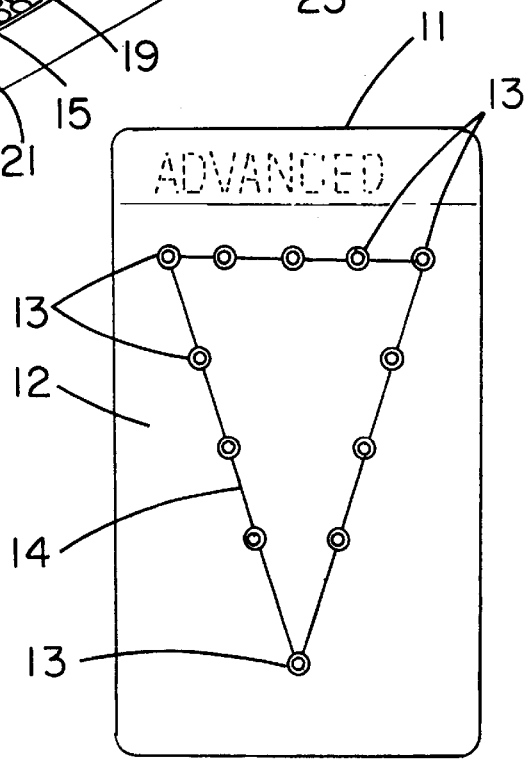
FIG. 2 is a top plan view of one of the game boards of the present invention.
Figure 5:
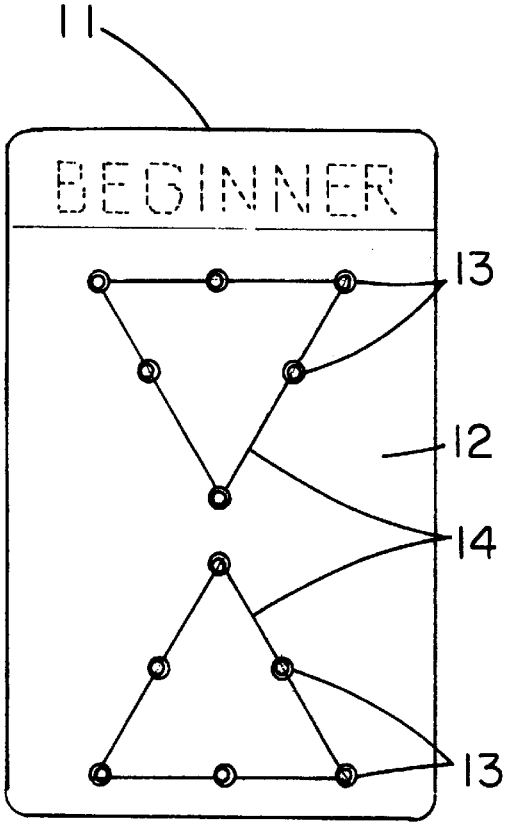
FIG. 5 is a top plan view of a game board for a beginner of the present invention.
Figure 6:
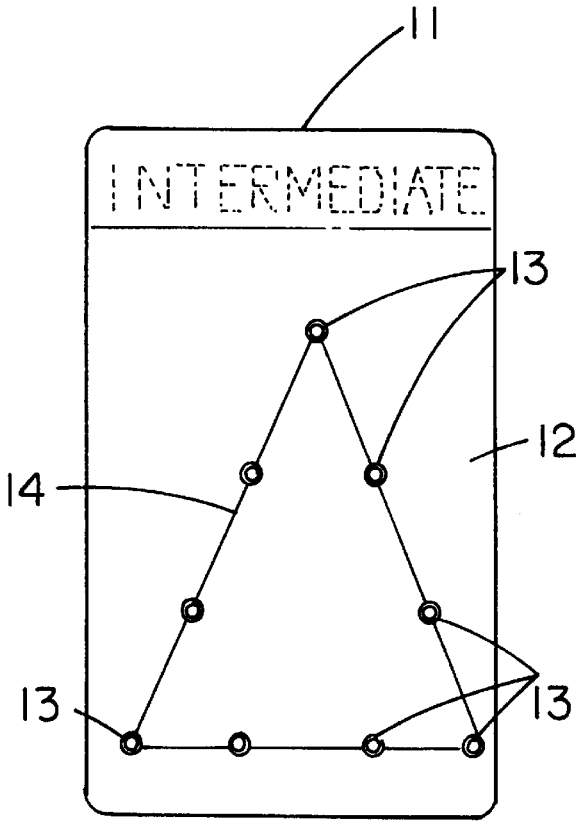
FIG. 6 is a top plan view of a game board for an intermediate user of the present invention.
Figure 7:
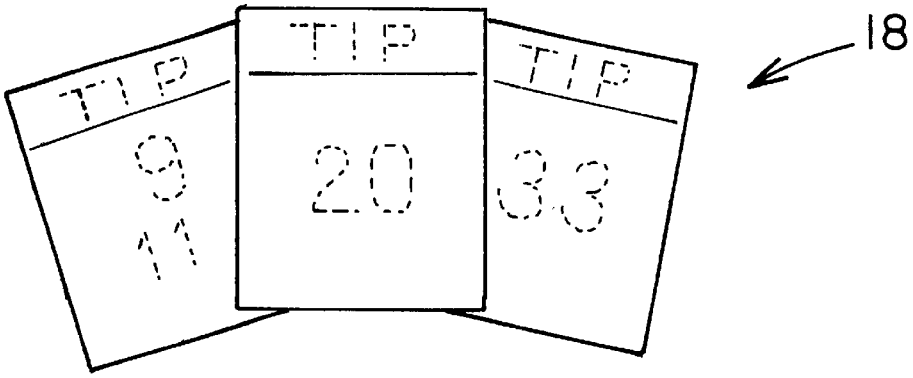
FIG. 7 is a top plan view of the tip cards of the present invention.

With reference now to the drawings, and in particular to FIGS. 1 through 7 thereof, a new summation of numbers board puzzle embodying the principles and concepts of the present invention and generally designated by the reference numeral 10 will be described.

As best illustrated in FIGS. 1 through 7, the summation of numbers board puzzle 10 generally comprises a plurality of game boards 11 each of which has a top side 12 and a plurality of holes 13 arranged in a triangular pattern 14 in the top side 12. Each side of a particular triangular pattern 14 has the same number of holes 13 as each of the other sides of the triangular pattern 14. The holes 13 are spaced along the sides of the triangular pattern 14. Each vertex of a particular the triangular pattern 14 has its own the hole 13.

A plurality of sets of pegs 15,28 with each peg having a top side 16 and having a number 17 disclosed on the top side 16 are used to solve the puzzle. The number 17 on each peg is exclusive to the particular set 15,28 to which the peg belongs. The holes 13 in the game boards 11 are adapted to receive the pegs 15,28.

A plurality of tip cards 18 for aiding a user in solving the puzzle are also provided with this puzzle. The tip cards 18 include information disclosed thereon for assisting a user to solve the puzzle. A sealable answer sheet 19 includes the answers to solving the puzzle and are contained in a sealable member 20 such as a plastic bag. A container 21 having side walls 23,24, a bottom wall 22, a removable cover 26, and partitioned compartments therein is used to store the game boards 11, the pegs 15,28, the tip cards 18, and the answer sheet 19. The container 21 includes a slot 25 extending in a front side wall 24 and further includes the cover 26 having a foldable end portion 27 for removably extending in the slot 25 to close over the container 21. The triangular pattern 14 includes either six holes 13 with each side of the triangular pattern 14 having three holes 13 including two of the vertexes, or nine holes 13 with each side of the triangular pattern 14 having four holes 13 including two of the vertexes, or twelve holes 13 with each side of the triangular pattern 14 having five holes including two of the vertexes.

In use, the user inserts the pegs 15,28 from one particular set of pegs into the holes 13 on a particular game board 11 and arranges the pegs 13 along each side of the triangular pattern 14 such that the summation of the numbers 17 disclosed on each peg 15,28 for a particular side equals the summation of the numbers 17 for each of the other sides.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A summation of numbers board puzzle comprising:

a plurality of game boards each of which has a top side, a triangular path being marked on the top side of each of said game boards, a plurality of holes being formed in the top side of each of said game boards, said plurality of holes being arranged along the triangular path of each of said game boards;

a plurality of sets of pegs with each peg having a top side and having a number disclosed on said top side, said number being exclusive to the particular set to which said peg belongs, said holes in said game boards being adapted to receive said pegs;

a plurality of tip cards for aiding a user in solving the puzzle;

a sealable answer sheet which includes the answers to solving the puzzle; and a container having side walls, a bottom wall, and a removable cover, said container further having partitioned compartments therein for storing said game boards, said pegs, said tip cards, and said answer sheet.

2. A summation of numbers board puzzle as described in claim 1, wherein each side of a particular said triangular pattern has the same number of holes as each of the other sides of said triangular pattern, said holes being spaced along the sides of said triangular pattern.

3. A summation of numbers board puzzle as described in claim 1, wherein each vertex of a particular said triangular pattern has its own said hole.

4. A summation of numbers board puzzle as described in claim 1, wherein each of said tip cards includes information disclosed thereon for assisting a user to solve the puzzle.

5. A summation of numbers board puzzle as described in claim 1, wherein said answer sheet is contained in a sealable member.

6. A summation of number board puzzle as described in claim 1, wherein said container includes a slot extending in a front side wall and further includes said cover having a foldable end portion for removably extending in said slot for covering over said container.

7. A summation of numbers board puzzle comprising:

a plurality of game boards each of which has a top side, a triangular path being marked on the top side of each of said game boards, a plurality of holes being formed in the top side of each of said game boards, said plurality of holes being arranged along the triangular path of each of said game boards, said holes being spaced along the sides of said triangular pattern, each vertex of a particular said triangular pattern having its own said hole;

a plurality of sets of pegs with each peg having a top side and having a number exposed on said top side, said number being exclusive to the particular set to which said peg belongs, said holes in said game boards being adapted to receive said pegs;

a plurality of tip cards for aiding a user in solving the puzzle, each of said tip cards including information disclosed thereon for assisting a user to solve the puzzle;

a sealable answer sheet which includes the answers to solving the puzzle, said answer sheet being contained in a sealable member; and a container having side walls, a bottom wall, and a removable cover, said container further having partitioned compartments therein for storing said game boards, said pegs, said tip cards, and said answer sheet, said container including a slot extending in a front side wall and further including said cover having a foldable end portion for removably extending in said slot to close over said container.

8. A summation of numbers board puzzle as described in claim 7, wherein said triangular pattern includes six said holes, wherein each said side of said triangular pattern includes three said holes including two of said vertexes.

9. A summation of numbers board puzzle as described in claim 7 ,wherein said triangular pattern includes nine said holes, wherein each said side of said triangular pattern includes four said holes including two of said vertexes.

10. A summation of numbers board puzzle as described in claim 7, wherein said triangular pattern includes twelve said holes, wherein each said side of said triangular pattern includes five said holes including two of said vertexes.

11. The method of solving the summation of numbers board puzzle includes the steps of:

providing a plurality of game boards each of which has a top side, a triangular path being marked on the top side of each of said game boards, a plurality of holes being formed in the top side of each of said game boards, said plurality of holes being arranged along the triangular path of each of said game boards, a plurality of sets of pegs with each peg being exclusively numbered for the particular set to which it belongs; a plurality of tip cards, and an answer sheet;

inserting said pegs from one particular said set of pegs into said holes on a particular said game board; and arranging said pegs along each side of said triangular pattern such that the summation of the numbers disclosed on each said peg for a particular said side equals the summation of the numbers for each of the other said sides.

12. A summation of numbers board puzzle as described in claim 1, wherein said triangular pattern on one of said game boards includes six said holes, wherein each said side of said triangular pattern includes three said holes including two of said vertexes, wherein said triangular pattern on one of said game boards includes nine said holes, wherein each said side of said triangular pattern includes four said holes including two of said vertexes, and wherein said triangular pattern on one of said game boards includes twelve said holes, wherein each said side of said triangular pattern includes five said holes including two of said vertexes.

* * * * *